US006502976B1

(12) United States Patent
Bernhard

(10) Patent No.: US 6,502,976 B1
(45) Date of Patent: Jan. 7, 2003

(54) ILLUMINATION APPARATUS

(76) Inventor: Jordan S. Bernhard, 1105 Tower Rd., Beverly Hills, CA (US) 90210

( * ) Notice: Subject to any disclaimer, the term of this patent is extended or adjusted under 35 U.S.C. 154(b) by 0 days.

(21) Appl. No.: 09/577,405

(22) Filed: May 22, 2000

(51) Int. Cl.[7] ..... F21V 33/00

(52) U.S. Cl. ..... 362/555; 362/551; 362/190; 362/253; 362/234

(58) Field of Search ..... 362/551, 253, 362/190, 191, 31, 555, 184, 800, 234; 294/118

(56) References Cited

U.S. PATENT DOCUMENTS

| | | | | | |
|---|---|---|---|---|---|
| 332,453 | A | | 12/1885 | Smith | |
| 1,913,780 | A | | 6/1933 | Wappler | |
| 2,521,251 | A | | 9/1950 | Petit | |
| 2,858,416 | A | | 10/1958 | Höver | |
| 3,135,003 | A | | 6/1964 | Wise | |
| 3,496,348 | A | | 2/1970 | Lowery | |
| 3,624,382 | A | | 11/1971 | White | |
| 3,672,749 | A | | 6/1972 | Roser | |
| 4,911,492 | A | | 3/1990 | Ward | |
| 4,955,657 | A | * | 9/1990 | Ward | 294/118 |
| 5,021,933 | A | | 6/1991 | Cordes | |
| 5,144,481 | A | | 9/1992 | Pettito, Sr. | |
| D337,839 | S | | 7/1993 | Zeller | |
| 5,458,386 | A | | 10/1995 | Buthman | |
| 5,644,438 | A | | 7/1997 | Pottash | |
| 5,662,404 | A | * | 9/1997 | Susat | 362/253 |
| 5,774,271 | A | * | 6/1998 | Lagerway et al. | 362/551 |
| 6,290,381 | B1 | * | 9/2001 | Mangum et al. | 362/554 |

OTHER PUBLICATIONS

*Handsome Rewards* catalog 19465 Brennan Avenue, Perris, CA 92599; Item #12–40068–5 illustrating a Light–Up Magnifier.

* cited by examiner

*Primary Examiner*—Thomas M. Sember
(74) *Attorney, Agent, or Firm*—Kirkpatrick & Lockhart LLP

(57) ABSTRACT

An illumination apparatus. In one embodiment, the illumination apparatus includes a hollow tube, a light and a housing. The hollow tube has a proximal end that is attached to the housing and defines an access passage therethrough. An illuminator is disposed at the distal end of the hollow tube. Additionally, a method of accessing a constrained area through an opening in an object. The method may include suspending a hollow member with at least one illuminator disposed at a proximal end thereof through the opening, illuminating the illuminator, and viewing the constrained area through an access passage defined by the hollow member.

33 Claims, 6 Drawing Sheets

ILLUMINATION APPARATUS

CROSS-REFERENCE TO RELATED APPLICATIONS

Not Applicable.

FEDERALLY SPONSORED RESEARCH

Not Applicable.

BACKGROUND OF THE INVENTION

1. Field of the Invention

The present invention relates to illumination apparatuses and, more particularly, to an illumination apparatus having an access opening disposed therethrough.

2. Description of the Invention Background

Disposals that are drain mounted to a kitchen sink are commonly employed in many households and commercial establishments. Such disposals generally have a 3 inch annular opening for receiving food and other grindable materials that are compatible for disposal in sewage or septic systems. Materials that pass through the opening are generally held in a cylindrical grinding chamber having holes through its lower portion through which liquid and small particles may pass to a drain conduit attached thereto. Such disposals typically contain a grinding mechanism within the grinding chamber which, when energized, grinds and pulverizes the materials received within the grinding chamber to a consistency that enables them to pass through the holes in the chamber. Thus, after waste material has been admitted into the grinding chamber, the grinding mechanism may be energized to grind and force the material into the drain conduit. Generally, water is permitted to flow into the grinding chamber when the grinding mechanism is energized to assist in washing the pulverized material through the holes in the grinding chamber.

A drawback to such disposal devices is that valuables and other objects that one does not wish to dispose of may inadvertently fall through the annular opening into the grinding chamber. For example, rings, ungrindable foods, and small cooking utensils may accidentally fall into such disposals when placing waste materials into the disposal. Retrieving such materials and objects can be difficult and dangerous. For example, retrieval may be made difficult by the small size of the annular opening and by the dark conditions existing within the disposal. The dark conditions are often intensified by placement of an instrument or tool through the annular opening, thus blocking the annular opening with the instrument or one's hand. Access to the grinding chamber of the disposal may also be hampered by a splash guard and stopper which may be utilized in the annular opening of the disposal. The splash guard and stopper is generally a rubber insert that fits inside of the drain pipe leading to the disposal. The splash guard and stopper typically includes rubber protrusions that extend toward the center of the drain for the purpose of preventing waste materials from being flung out of the chamber when the grinding mechanism is operated. The stopper may likewise prevent large objects from entering the grinding chamber.

Retrieving an object by hand from a constrained area, such as a disposal grinding chamber, may be dangerous because the size of the drain opening may prevent one from removing one's hand or an instrument from the chamber once inserted. Retrieval is furthermore made dangerous by the grinding mechanism disposed within the grinding chamber of the disposal. If the grinding mechanism is energized during the retrieval process, one's hand, a removal instrument, or the object being retrieved could be injured or damaged by inadvertent operation of the grinding mechanism.

Thus, there is a need for an apparatus that facilitates retrieval of lost items from a constrained area, such as the grinding chamber of a disposal.

There is a further need for an apparatus that illuminates a constrained area.

Furthermore, the need for illuminated access to constrained openings may not be limited solely to waste material disposals. Similar needs may be encountered in larger drains, pipes, conduits, etc. It is also conceivable that such access may be required in connection with a variety of different types of machinery, appliances, etc.

There is also a need for a method of safely removing an object from a constrained area, and a need for a method of safely removing an object from a constrained area containing a dangerous mechanism.

Still another need exists for a device that has the above-mentioned attributes that is relatively easy and inexpensive to manufacture.

Yet another need exists for a device with the above-mentioned attributes that is relatively self-contained and does not require a separate source of power.

Another need exists for an illumination device that may be used to illuminate a constrained area and permit access therethrough, wherein the illumination device is relatively water and moisture resistant.

SUMMARY OF THE INVENTION

The present invention is directed to an illumination apparatus. In one embodiment, the illumination apparatus includes a hollow tube, a light and a housing. The hollow tube has a proximal end that is attached to the housing and defines an access passage therethrough. An illuminator is disposed at the distal end of the hollow tube.

Additionally, a method of accessing a constrained area through an opening in an object is disclosed. The method may include suspending a hollow member with at least one illuminator disposed at a proximal end thereof through the opening, illuminating the illuminator, and viewing the constrained area through an access passage defined by the hollow member.

Thus, the present invention offers the features of illuminating a constrained area, such as the grinding chamber of a disposal, and furthermore facilitates retrieval of lost items from the constrained area.

Another feature of the present invention is that it provides a method of safely removing an object from an constrained area and furthermore provides a method of safely removing an object from a constrained area containing a dangerous mechanism.

The present invention is also beneficially easy and inexpensive to manufacture. Yet another feature of the present invention is that it is self contained and does not require a separate source of power.

Additionally, it is a feature of that the present invention is relatively water and moisture resistant. Accordingly, the present invention provides solutions to the shortcomings of conventional apparatuses and methods of illuminating and retrieving an object from a constrained area. Those of ordinary skill in the art will appreciate, however, that these and other details, features and advantages will become further apparent as the following detailed description proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE INVENTION

Figure 1:
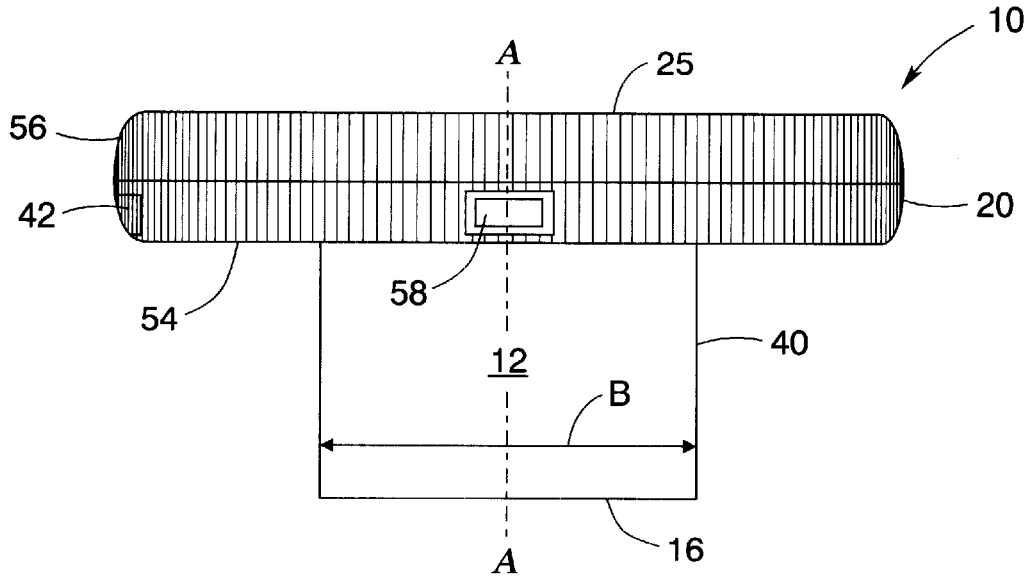
FIG. 1 is a front elevational view of an illumination apparatus of the present invention.
Figure 2:
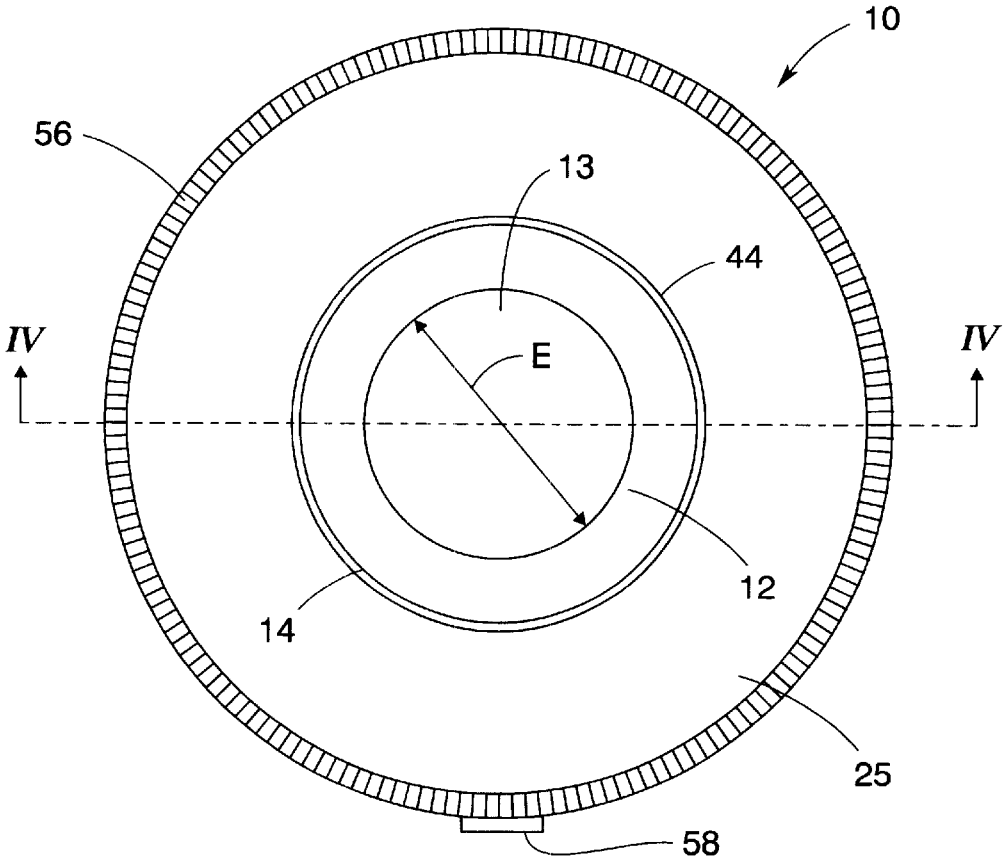
FIG. 2 is a top view of the illumination apparatus of FIG. 1.
Figure 3:
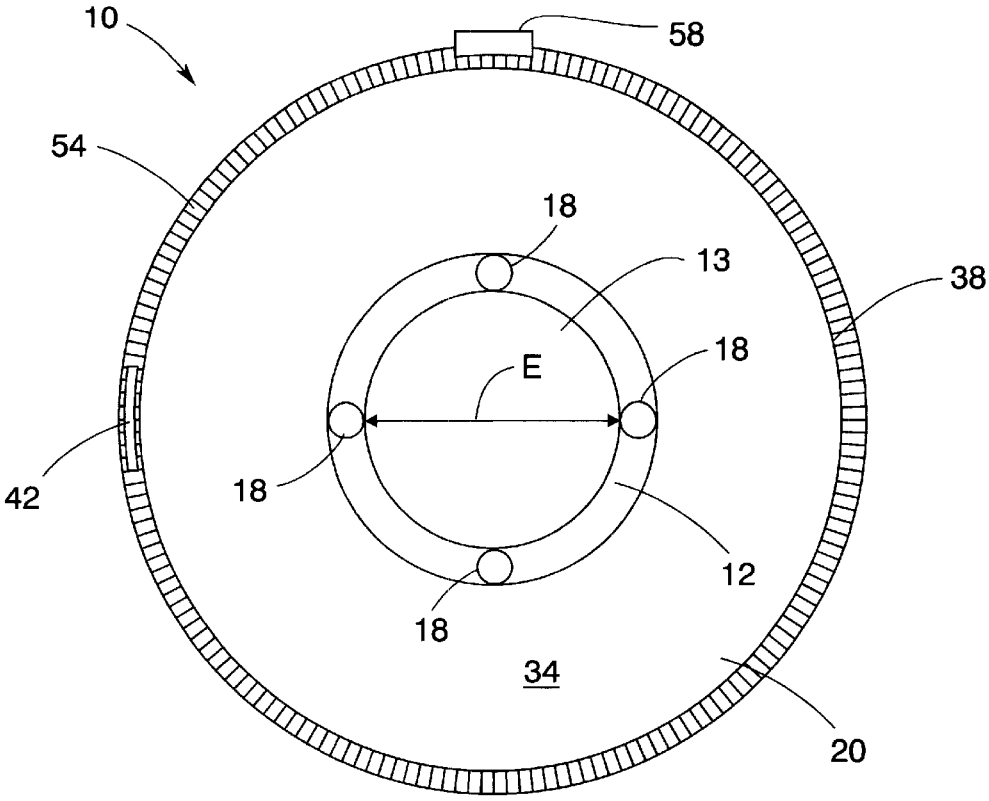
FIG. 3 is a bottom view of the illumination apparatus of FIGS. 1 and 2.

Referring now to the drawings for the purpose of illustrating present embodiments of the invention only and not for the purpose of limiting the same, FIG. 1 shows a front elevational view of an illumination apparatus 10 of the present invention that includes a hollow viewing and access tube 12 that is open throughout its length. The subject illumination apparatus 10 is particularly well-suited for accessing a constrained area through an opening in an object. For example, as will be discussed in further detail below with reference to FIG. 6, the present invention may be used to access a constrained area 111 defined by a grinding chamber 110 of a disposal apparatus 100 through an opening 102 in a sink 104. The viewing and access tube 12 has a proximal end 14 (FIG. 2) and a distal end 16 (FIG. 1), and defines an access passage 13 (FIG. 4) extending therethrough along a central axis A—A. At least one illuminator or light source 18 is disposed at the distal end 16 of the viewing and access tube 12. See FIG. 3. The light source 18 may be contained within a wall 36 of the tube 12 and may direct light from the distal end 16 of the tube 12 along an axis parallel to the axis A—A of the tube 12. Alternately, the light 18 may be positioned to direct light at an angle relative to the axis A—A of the tube 12, or may be swivelably or rotatably mounted such that the light source 18 may be directed in a desired direction. FIG. 3 illustrates an illumination apparatus incorporating four flush mounted lights 18 into the viewing and access tube 12. A support member or housing 20 is attached to the proximal end 14 of the tube 12 or formed integral therewith, and that housing 20 may contain a power source 22 or an interface 24 for coupling the lights 18 to a remote power source such as remotely located batteries or other source of A/C or D/C power (not shown). A cap 25 may be attached to the housing 20 to enclose the power source 22 and/or interface 24.

Figure 6:
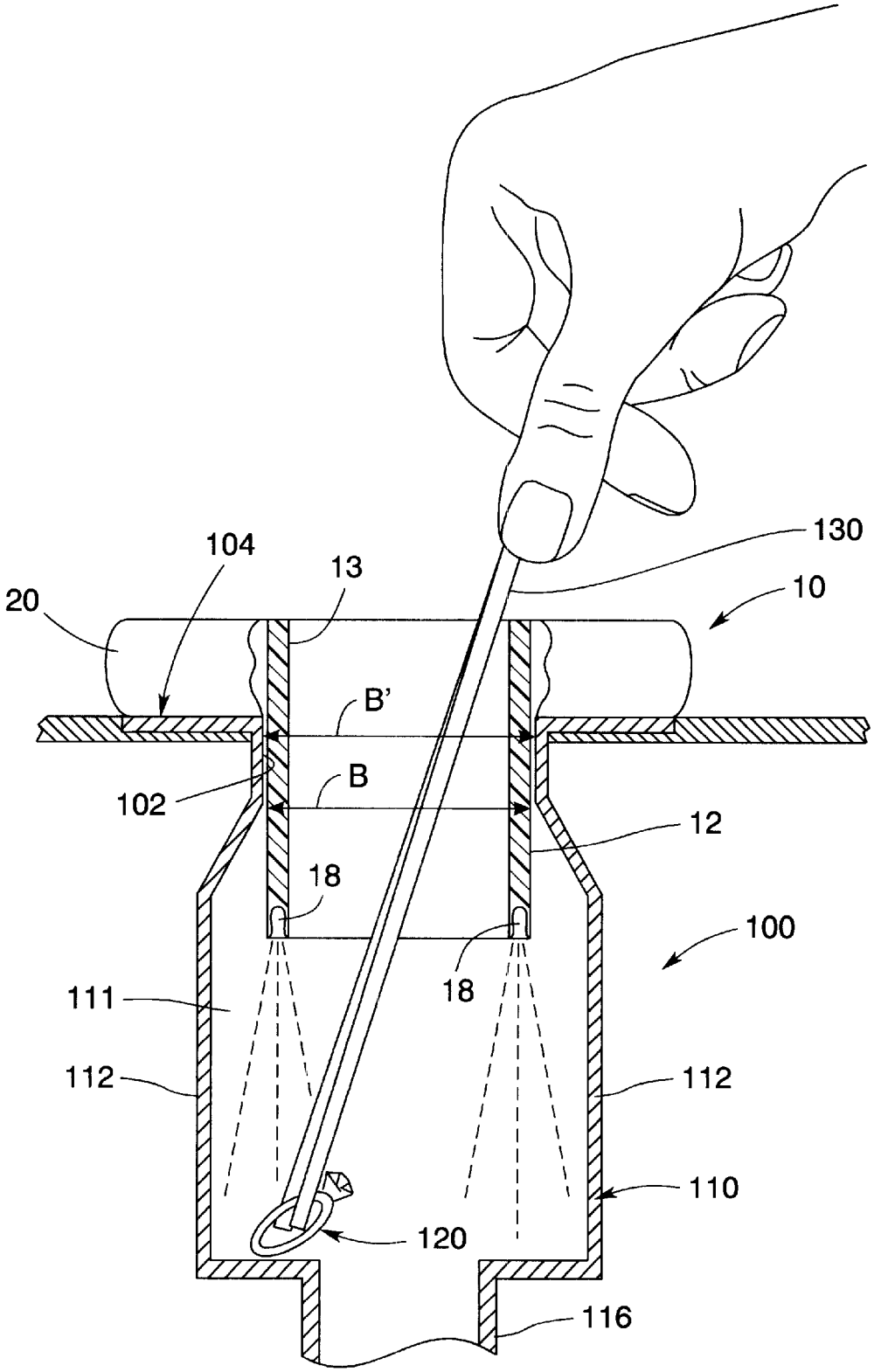
FIG. 6 is a partial cross-sectional view of the illumination apparatus of FIGS. 1–5 to retrieve an object from a sink-mounted waste disposal.

The viewing and access tube 12 may be fabricated from a variety of different materials such as, for example, plastic, magnesium, aluminum, fiberglass, or any other material suitable for use in connection with the desired application. The hollow tube 12 may, for example, be constructed of plastic and have a "first" outside diameter (represented by arrow "B" in FIGS. 1 and 4) of approximately 2½ inches and a length (represented by arrow "C" in FIG. 4) of approximately 4 inches when constructed for use with a common kitchen sink drain mounted disposal 100. See FIG. 6. The outside diameter "B" of the tube 12 should be less than the inside diameter "B'" of the drain mounted disposal 100 or other constrained area (not shown) such as a conduit (not shown) into which the tube 12 is to be placed. In applications where a standard splash guard and stopper (not shown), such as those typically used with drain mounted disposals, is utilized, the tube 12 should be sized such that the protrusions of the splash guard and stopper may be pressed outward when the tube 12 is inserted within the splash guard and stopper without creating a fit that is unnecessarily tight, so that the tube 12 may be easily inserted into and removed from the drain. Thus, when the tube 12 is placed into the drain, it will displace the rubber protrusions of the splash guard and stopper if such a splash guard and stopper is present in the drain. It may be desirable for the tube 12 to extend sufficiently long enough that it may reach into the drain beyond any obstructions such as, for example, the splash guard and stopper to facilitate relatively unimpeded access through the tube 12. In a sink mounted disposal application as shown in FIG. 6, it may be beneficial for the length of the tube 12 to be sized such that the tube 12 does not extend into a grinding chamber 110 of the disposal or extends only minimally into the grinding chamber of the disposal. The grinding chamber 110 will generally have a diameter greater than the drain opening 102 and greater than the diameter of the tube 12. Thus, a tube 12 that does not extend into the grinding chamber 110 or minimally extends into the grinding chamber 110 will not impede viewing along side walls of the grinding chamber 110 and will not impede access to objects 120 or materials lying along the side walls 112 of the chamber 110. Likewise, when the illumination apparatus 10 is utilized to access a conduit, it may be preferable for the tube 12 to be sized such that it does not extend into the conduit beyond the area to be accessed so that the tube 12 does not inhibit or hamper viewing of and access to the desired portion of the conduit.

Figure 7A:
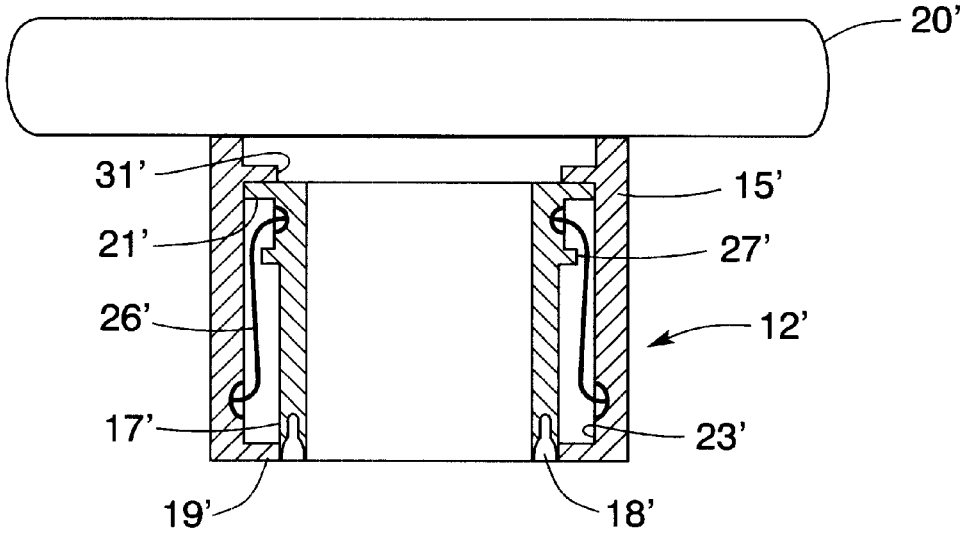
FIG. 7A is a partial cross-sectional view of another embodiment of the illumination apparatus of the present invention wherein the viewing and access tube telescopes and wherein viewing and access tube is shown in a retracted position.
Figure 7B:
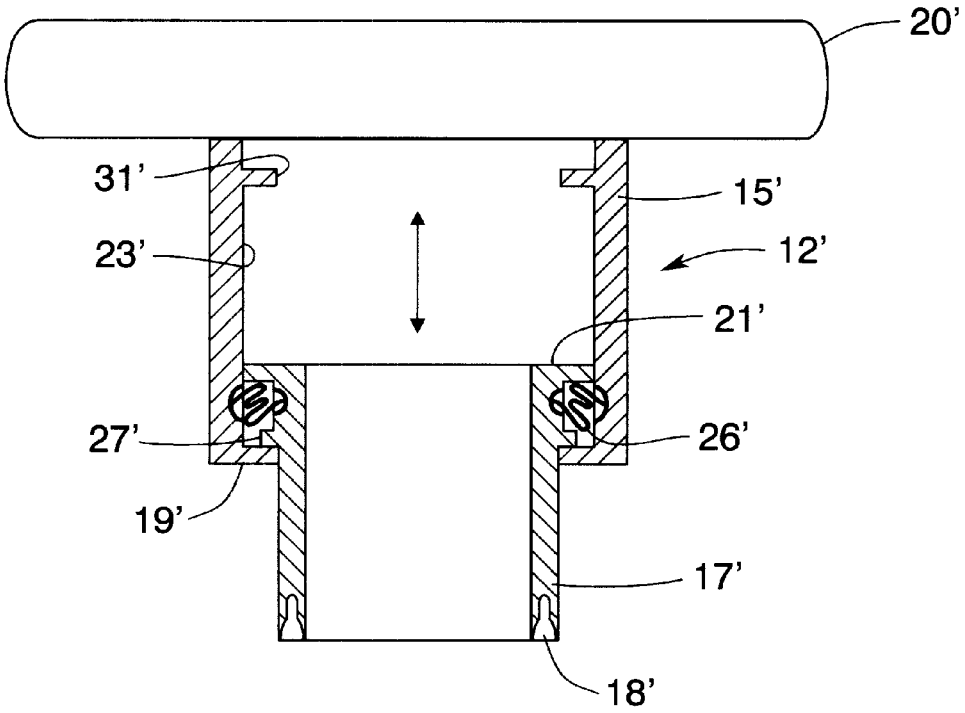
FIG. 7B is a partial cross-sectional view of the illumination apparatus FIG. 7A wherein the viewing and access tube is shown in an extended position.

In another embodiment of the present invention as shown in FIGS. 7A and 7B, the viewing and access tube 12' may have an adjustable length. This embodiment is essentially identical in construction to the embodiment described above, however, in this embodiment, the tube 12' telescopes. More particularly and with reference to FIG. 7A which illustrates the tube 12' in a retracted position and FIG. 7B which illustrates the tube 12' in an extended position, the tube 12' has a hollow upper section 15' and a hollow lower telescoping section 17'. The upper section 15' is essentially constructed as described above with respect to tube 12'. However, in this embodiment the upper section 15' has an upper inwardly extending flange 31' and a lower inwardly extending flange 19'. The lower section 17' has a lower flange 27' and an upper flanged portion 21' that is sized to slidably move within the access passage 23' of the upper section 15'. As can be seen in FIG. 7B, when the lower section 17' is fully extended, the lower flanged portion 27' of the lower section 17' engages the lower inwardly extending flanged portion 19' of the upper section 15' to prevent the lower telescoping section 17' from being detached from the upper section 15'. A wire 26' may be extended from the upper section 15' to the lower section 17' between the upper flange 21' of the lower section 17' and the lower flange 27' of the lower section 17'. Thus, the wire 26' may coil between the upper flange 21' and the lower flange 27' when the viewing and access tube 12' is telescoped to the extended position without crimping the wire 26', as shown in FIG. 7B. While the embodiment depicted in FIGS. 7A and 7B illustrates the use of lights 18' only in the lower telescoping section 17', those of ordinary skill in the art will readily appreciate that lights 18 could also conceivably be employed only in the upper section 15' or in both the upper and lower telescoping sections 15' and 17'. It will be further appreciated that, in the alternative, the length of the tube 12' may be adjustable by any means known.

Figure 4:
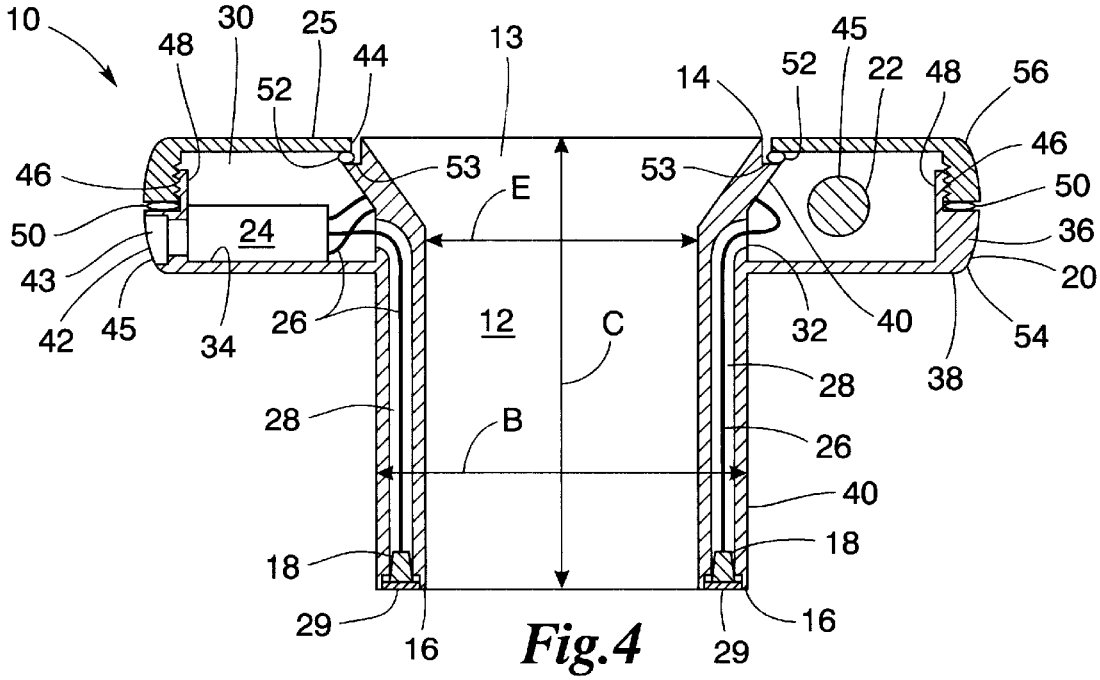
FIG. 4 is a cross-sectional view of the illumination apparatus of FIG. 2, taken along line IV—IV in FIG. 2.

As illustrated in FIG. 4, the lights 18 may be flush mounted in the distal end 16 of the viewing and access tube 12. The lights 18 may be of any type known including, for example, incandescent or fluorescent lights, LEDs, or a chemically illuminating material. The lights 18 may also comprise conventional fiber optic lights. Conductors 26 such as, for example, copper wires or fiber optic cable, may furthermore be run from the power source 22 to the distal end 16 of the tube 12 through bores 28 formed in the tube 12. The lights 18 may be mounted in a known watertight fashion such that water or other liquids may not pass the lights 18 and gain access to the bores 28. One method for preventing moisture infiltration into wire bores 28 would be to hermetically seal the lights 18 into the tube 12 with a commercially available sealant. Moreover, in those applications wherein it may not be desirable to replace the lights 18, the lights 18 may be permanently sealed in position. However, in those applications wherein light replacement is desirable, removable sealant adhesive may be employed. Furthermore, depending upon the type and construction of lights 18 employed, a myriad of other sealing and fastening arrangements may be employed. For example, in those embodiments wherein the lights 18 are threaded into a light socket embedded in the tube 12, conventional O-ring seal arrangements may be employed. A transparent waterproof cover 29 may also be placed over each light 18 to prevent liquids from contacting the lights 18 or infiltrating into the bores 28.

The housing 20 may be attached to the viewing and access tube 12, or may alternately be integrally formed with the tube 12 as shown in FIG. 4. As depicted in the Figures, housing 20 has a substantially round shape. However, the skilled artisan will appreciate that housing 20 may be provided in a variety of different shapes. In the embodiment depicted in FIGS. 4 and 5, housing 20 has an outside or "primary diameter D" that is larger than the outside diameter B of the tube 12. For example, where B is approximately 3 inches, D may be approximately 5 inches. The reader will appreciate that the housing 20 acts as a support flange for the viewing and access tube 12 such that the tube 12 may be suspended into a drain opening that is smaller that the outer or primary diameter D of the housing 20. When the housing 20 is thus attached to or is integrally formed with the proximal end 14 of the viewing and access tube 12, extending outward from an outer surface 40 of the tube 12, the housing 20 forms a flange that will prevent the illumination apparatus 10 from falling entirely into the constrained area to be accessed. Thus, the distal end 16 of the tube 12 may be placed in the conduit until the housing 20 contacts an end of the conduit. Where a sink mounted disposal 100 is being accessed, for example, the tube 12 may extend into the drain until the housing 20 contacts a lower surface of a sink 104 where the disposal connects to the sink. See FIG. 6. The present invention contemplates the use of tube 12 and housing 20 configurations that do not have circular cross-sections. Thus, the term "primary diameter" of the housing 20 refers to the largest distances between outermost edges of the housing 20. The housing 20 may furthermore define a cavity 30 into which additional components may be disposed. The housing 20 may, for example, have an inner annular wall 32 defined by the viewing and access tube 12, a base 34 extending outward from the tube 12 and an outer annular wall 36 extending upward from the base 34 at an outer perimeter 38 of the base 34. In that embodiment, the inner annular wall 32, the base 34, and the outer annular wall 36 form the cavity 30.

Figure 5:
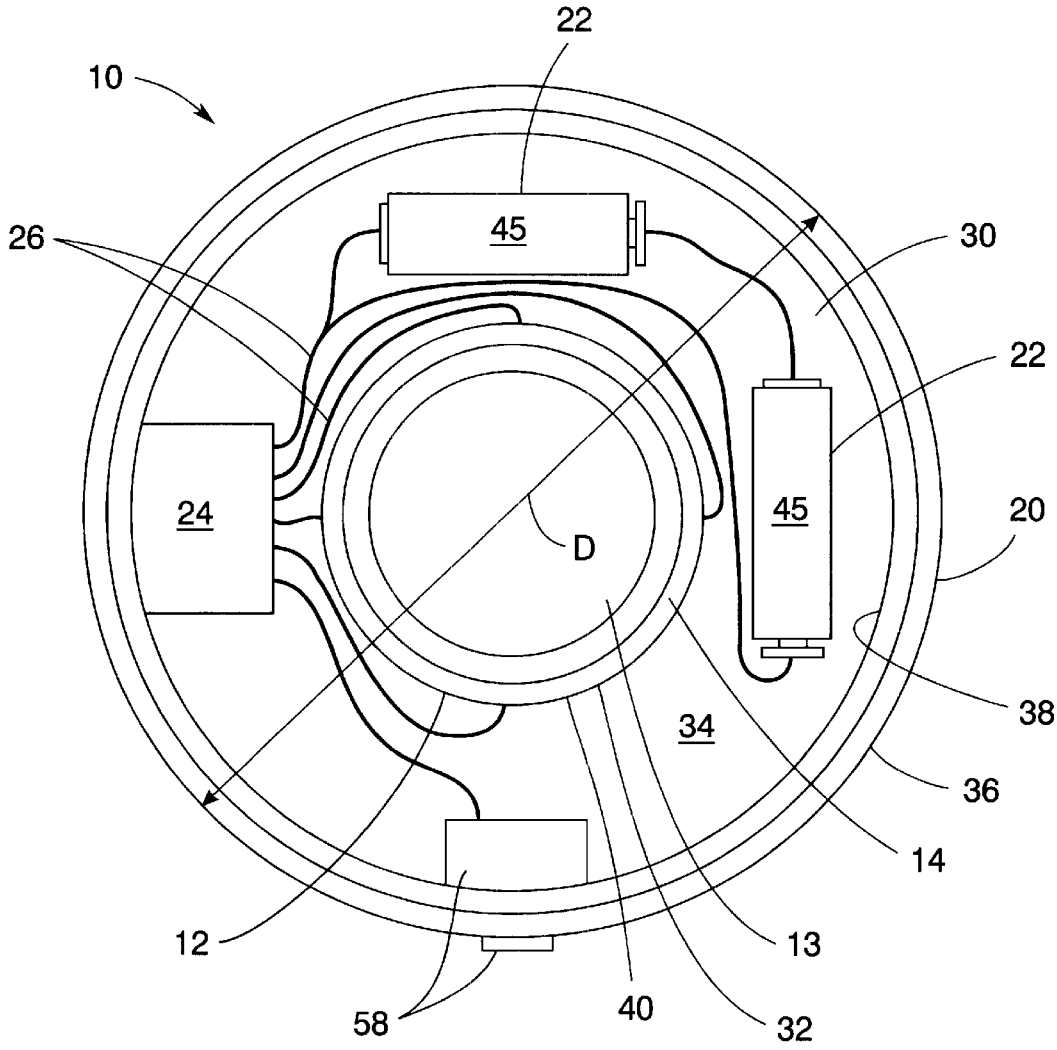
FIG. 5 is a top view of the illumination apparatus of FIG. 1, wherein the cap has removed from the illumination apparatus.

As illustrated in FIGS. 4 and 5, the cavity 30 defined by the housing 20 may be utilized to contain the power source 22 for powering the lights 18. The power source 22 may, for example, include a replaceable power source such as one or more commercially available disposable or rechargeable batteries 45. As illustrated in FIG. 5, two battery cells 45 may be coupled in series. The series batteries 45 serving as the power source 22 may then be connected to each light 18 by connecting copper conductors 26 from the batteries 45 to each light 18 in parallel. The housing 20 may alternately contain an interface 24 for connection to an external power source (not shown) such as, for example, an A/C power source or another D/C power source such as, for example, an external battery or a generator. A/C power from, for example, a common household outlet, may directly power the lights 18. However, to minimize the danger of shock to the user of the illumination apparatus 10, the power may be converted to low voltage alternating or direct current. The external power source may be coupled to the illumination apparatus 10 by way, for example, of a standard power supply plug (not shown) that attaches to the illumination apparatus 10 at the interface 24. The housing 20 of the illumination apparatus 10 may include an opening 43 through which the external power interface 24 may be accessed. The housing 20 may also include a punch-out section 42 formed over the opening 43 and integral with the housing 20 which may be removed by applying pressure to the punch-out section 42 if use of an external power source is desired. In the alternative, a removably detachable plug cap (not shown) may be employed to prevent undesirable infiltration of moisture and/or debris into the housing when not in use. The cavity 30 defined by the housing 20 may also contain a fiber optic illuminator (not shown) for illuminating one or more fibers when fibers are used as for illumination.

In the embodiment shown in FIGS. 4 and 5, the replaceable power source 22 and interface 24 are both provided in the housing 20. The power source 22 of that embodiment is comprised of two batteries 45. In that embodiment, the batteries 45 are coupled to the interface 24 and the interface 24 is coupled to the lights 18. The interface 24 in that embodiment may also contain a switch (not shown) that couples the batteries 45 to the lights 18 when an external power source is not connected to the interface 24, and uncouples the batteries 45 and couples the external power source to the lights 18 when an external power source is connected to the interface 24.

As illustrated in FIG. 4, the cap 25 may be threaded onto the housing 20. The cap 25 may also be fabricated from the same types of materials as the viewing and access tube 12 and may be utilized to enclose the cavity 30 defined by the housing 20. The skilled artisan will readily appreciate, however, that the cap 25 may be constructed to be removably snapped onto the housing 20 or other conventional methods of removable attachment could also be employed. The cap 25 may be an annular structure having a central hole 44 that is at least as large as the inner diameter (represented by arrow "E" in FIGS. 2–4) of the tube 12. Thus, the cap 25 will not restrict viewing or access through the tube 12. In the embodiment depicted in FIG. 4, the cap 25 has a threaded portion 46 for engaging a complimentary threaded portion 48 on the outer annular wall 36 of the housing 20. The cap 25 may additionally include a second threaded portion (not shown) for engaging a second complimentary threaded portion (not shown) formed on the inner annular wall 32 of the housing 20. A water tight seal may also be beneficially created between the cap 25 and the housing 20. Such a water tight seal may act to prevent moisture and other liquids from entering the cavity 30 formed between the cap 25 and the housing 20. For example, a sealing member 50 such as a conventional O-ring may be placed between the cap 25 and the housing 20 along the outer wall 36 of the housing 20, as shown in FIG. 4. Similarly, a second sealing member 52, which may also be an O-ring, may be placed in a groove 53 formed in the tube 12 to sealingly engage the cap 25, as shown in FIG. 4.

The housing 20 may have a textured outer surface 54 and/or the cap 25 may have a textured outer surface 56 to aid a user in gripping the illumination apparatus 10 during insertion of the apparatus 10 in the constrained area or removal of the apparatus 10 therefrom. The textured surfaces 54 and 56 may include ridges, for example, formed on the exterior surface 54 of the housing 20 and on the exterior surface 56 of the cap 25, as illustrated in FIG. 1.

A switch 58 may also be provided with the illumination apparatus 10 for coupling the power source 22 being utilized to the lights 18. The switch 58 may be accessible at the exterior surface 54 of the housing 20 and extend through the housing 20 into the cavity 30. The switch 58 may be of a conventional waterproof type to prevent moisture or liquid from entering the cavity 30 through the switch 58. The switch 58 may be actuated by any known means including toggling or depressing a button, for example. The switch 58 will typically be coupled to the conductor 26 between the power source or sources 22 and the lights 18 so as to prevent power from reaching the lights 18 when the switch 58 is in an off position and to supply power to the lights 18 when the switch 58 is in an on position.

In operation, the present illumination apparatus 10 provides illumination for viewing a hollow of a conduit or other constrained area and provides unimpeded access into the conduit or constrained area. It is contemplated that in one embodiment, the present apparatus 10 will facilitate removal of debris, lost articles and other objects from common drain pipes and drain mounted sink disposals 100 attached to common drain pipes 116 as shown in FIG. 6. Referring now to FIG. 6, an article such as a ring 120 is shown in the bottom of the grinding chamber 110 of the disposal 100. To facilitate easy retrieval of the ring 120, the tube 12 of the illumination apparatus 10 of the present invention is inserted into the drain opening 102 until the housing rests on the sink 104. Thereafter, the lights 18 may be energized by activating the switch 58. The reader will of course appreciate that the lights 18 may be energized prior to placing the apparatus 10 of the present invention into the drain opening 102. After the apparatus 10 is inserted into the drain opening 102 and the lights 18 are energized as shown in FIG. 6, the bottom of the grinding chamber 110 will be conveniently illuminated to thereby permit easy viewing of the article 120. After the article has been located, the user may use any convenient means of retrieval such as a pair of conventional tongs 130 to retrieve the article through the access passage 13 in the tube 12. As depicted in FIG. 6, the user simply inserts the retrieval member through passage 13 to retrieve the article 120 from the bottom of the grinding chamber 110. After the article 120 has been retrieved, the apparatus 10 is removed from the drain opening 102, the lights 18 are de-energized and the apparatus 10 is stored until needed again. It is also contemplated that the present illumination apparatus 10 may be sized and constructed of appropriate materials so as to be utilized in a wide variety of applications including use with hand holes and man holes, wherein, for example, an instrument, a portion of a human body, an entire human, an animal, or a large piece of equipment may gain access to a constrained area through the illumination device 10.

Figure 8:
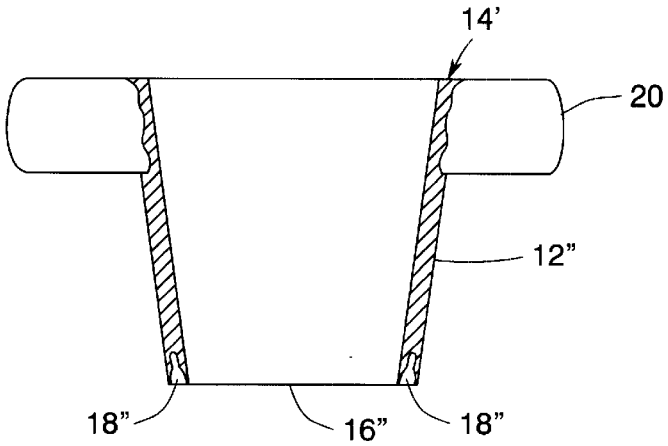
FIG. 8 is a partial cross-sectional view of another embodiment of the illumination apparatus of the present invention that employs a tapered viewing and access tube.
Figure 9:
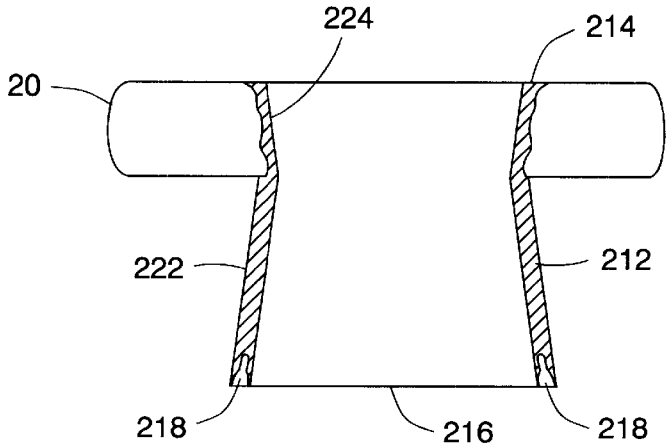
FIG. 9 is a partial cross-sectional view of another embodiment of the illumination apparatus of the present invention that employs a viewing and access tube having tapering upper and lower portions.
Figure 10:
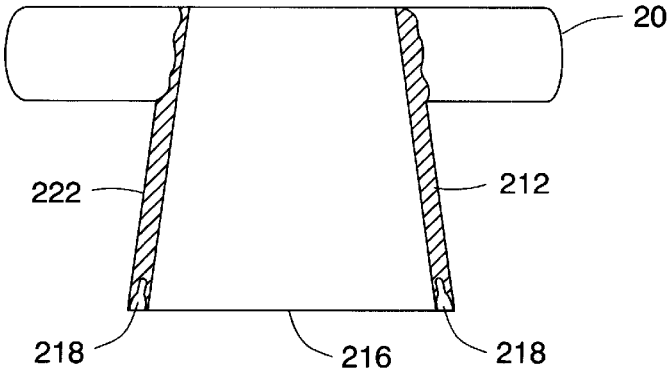
FIG. 10 is a partial cross-sectional view of another embodiment of the illumination apparatus of the present invention that employs a tapered viewing and access tube.

In another embodiment, as shown in FIG. 8, the viewing and access tube 12" may taper outward toward the proximal end 14" throughout the length of the viewing and access tube 12" to facilitate access to the constrained area. The reader will appreciate that the lights 18" are mounted in the distal end 16" of the tube 12" in the manner described above. The housing 20 and the various components therein are otherwise constructed and operate as described hereinabove. Likewise, as shown in FIGS. 9 and 10, the viewing and access tube 212 may have an outward taper at the distal end 216 to facilitate angled access to the constrained area. FIG. 9 illustrates an embodiment of the illumination apparatus 10 in which a lower portion 222 of the viewing and access tube 212 tapers outward to the distal end 216 thereof, and an upper portion 224 of the viewing and access tube 212 tapers outward to the proximal end 214 thereof. FIG. 10 illustrates an embodiment of the illumination apparatus 10 in which the viewing and access tube 212 tapers outward to the distal end 216 thereof. The lights 218 may be mounted in the distal end 216 and otherwise operate as described above in those embodiments. The reader will also appreciate that housing 20 and the components therein, as shown in FIGS. 9 and 10, may be constructed and operate as described above.

A method of accessing a conduit or other constrained area is also contemplated. In the method, the proximal end 14 of an illumination apparatus 10 having a hollow tube 12 with at least one light 18 disposed at the distal end 16 of the tube 12 is disposed in a conduit or constrained area. The constrained area is then viewed and accessed through the hollow tube 12. The method may include removing an object from the constrained area or placing an object into the constrained area.

Those of ordinary skill in the art will recognize that many modifications and variations of the present invention may be implemented. The foregoing description and the following claims are intended to cover all such modifications and variations. Furthermore, the materials and processes disclosed are illustrative of the invention but are not exhaustive. Other materials and processes may also be used to utilize the present invention.

What is claimed is:

1. An illumination apparatus, comprising:

a housing having a primary outer diameter and defining a cavity;

a cap removably attached to said housing, said cap completely enclosing said cavity when said cap is attached to said housing;

a hollow tube having a proximal end and a distal end, said proximal end of said hollow tube attached to said housing and being aligned with an opening through said housing to define an unobstructed access passage that extends completely through said housing and said hollow tube, said hollow tube having a first diameter that is less than said primary diameter of said housing; and an illuminator disposed at said distal end of said hollow tube.

2. The apparatus of claim 1, further comprising a seal disposed between said housing and said cap.

3. The apparatus of claim 1, wherein said housing includes an inner wall and an outer wall, further comprising:

a first seal disposed between said cap and said inner wall of said housing; and a second seal disposed between said cap and said outer wall of said housing.

4. The apparatus of claim 3, wherein said first seal is an O-ring and said second seal is an O-ring.

5. The apparatus of claim 1, further comprising:

at least one replaceable power source disposed in a cavity in said housing; and at least one conductor coupled to said power source and said illuminator.

6. The apparatus of claim 5, wherein said at least one replaceable power source is a battery.

7. The apparatus of claim 1, further comprising:

a power source; and at least one conductor coupled to said power source and said illuminator.

8. The apparatus of claim 7, wherein said power source further comprises:

at least one replaceable power source disposed in a cavity in said housing; and an interface to an external power source disposed in said cavity of said housing.

9. The apparatus of claim 8, further comprising a switch connected between said illuminator and said replaceable power source and external power source.

10. The apparatus of claim 1, further comprising:

a power source; and a switch connected to said power source and said illuminator.

11. The apparatus of claim 1, wherein said illuminator is selected from the group of:

incandescent lights, florescent lights, LEDs, fiber optic lights, and chemically illuminating material.

12. The apparatus of claim 1, wherein said hollow tube is integrally formed with said housing.

13. The apparatus of claim 1 wherein said housing has a textured outer surface.

14. An illumination apparatus, comprising:

a hollow tube having a proximal end and a distal end, said hollow tube being disposed around a central axis and having a diameter;

a light disposed at said distal end of said hollow tube, said light directed parallel to said central axis of said hollow tube;

an annular housing attached to said proximal end of said hollow tube, said housing having a diameter greater than said diameter of said hollow tube, an inner annular wall, and outer annular wall, and defining a cavity;

a cap removably attached to said housing;

a first seal disposed between said cap and said inner annular wall of said housing;

a second seal disposed between said cap and said outer annular wall of said housing;

a power source disposed in said cavity;

at least one conductor coupled to said power source and said light; and a switch that selectively couples said power source to said light.

15. An apparatus for illuminating a constrained area accessible through an opening in an object, said apparatus comprising:

a hollow access tube having a proximal end and a distal end, said distal end sized to pass through the opening;

a supporter affixed to said proximal end of said hollow access tube and sized to abut a portion of the object and suspend said hollow tube therefrom into the opening, said supporter having an access opening extending therethrough coaxially aligned with a hollow passage extending through said hollow access tube to define an axial access passage that extends completely through the apparatus and through which another object may be passed; and an illuminator rotatably supported within the distal end of said hollow access tube.

16. An illumination apparatus, comprising:

a housing having a primary outer diameter;

a hollow tube having a proximal end and a distal end, said proximal end of said hollow tube attached to said housing and defining an access passage through said housing, said hollow tube having a first diameter that is less than said primary diameter of said housing;

an illuminator disposed at said distal end of said hollow tube;

at least one replaceable power source disposed in a cavity in said housing; and at least one conductor coupled to said power source and said illuminator.

17. The apparatus of claim 16 further comprising a cap removably attached to said housing.

18. The apparatus of claim 17, further comprising a seal disposed between said housing and said cap.

19. The apparatus of claim 17, wherein said housing includes an inner wall and an outer wall, further comprising:

a first seal disposed between said cap and said inner wall of said housing; and a second seal disposed between said cap and said outer wall of said housing.

20. The apparatus of claim 19, wherein said first seal is an O-ring and said second seal is an O-ring.

21. The apparatus of claim 16, wherein said at least one replaceable power source is a battery.

22. The apparatus of claim 16, wherein said illuminator is selected from the group of: incandescent lights, florescent lights, LEDs, fiber optic lights, and chemically illuminating material.

23. The apparatus of claim 16, wherein said hollow tube is integrally formed with said housing.

24. An illumination apparatus, comprising:

a housing having a primary outer diameter;

a hollow tube having a proximal end and a distal end, said proximal end of said hollow tube attached to said housing and defining an access passage through said housing, said hollow tube having a first diameter that is less than said primary diameter of said housing;

an illuminator disposed at said distal end of said hollow tube;

at least one replaceable power source disposed in a cavity in said housing;

at least one conductor coupled to said power source and said illuminator;

an interface to an external power source disposed in said cavity of said housing; and at least one other conductor coupled to said interface and said illuminator.

25. The apparatus of claim 24, further comprising a cap removably attached to said housing.

26. The apparatus of claim 25, further comprising a seal disposed between said housing and said cap.

27. The apparatus of claim 25, wherein said housing includes an inner wall and an outer wall, further comprising:

a first seal disposed between said cap and said inner wall of said housing; and a second seal disposed between said cap and said outer wall of said housing.

28. The apparatus of claim 27, wherein said first seal is an O-ring and said second seal is an O-ring.

29. The apparatus of claim 24, further comprising a switch connected between said illuminator and said replaceable power source.

30. The apparatus of claim 24, further comprising a switch connected between said illuminator and said interface.

31. The apparatus of claim 24, wherein said illuminator is selected from the group of: incandescent lights, florescent lights, LEDs, fiber optic lights, and chemically illuminating material.

32. The apparatus of claim 24, wherein said hollow tube is integrally formed with said housing.

33. An illumination apparatus, comprising:

a housing having a primary outer diameter and defining a cavity;

a cap removably attached to said housing;

a hollow tube having a proximal end and a distal end, said proximal end of said hollow tube attached to said housing and being coaxially aligned with an opening through said housing to define an axial access passage through which an object may pass, said axial passage extending completely through said housing and said hollow tube, said hollow tube having a first diameter that is less than said primary diameter of said housing; and an illuminator disposed at said distal end of said hollow tube without obstructing said access passage.

* * * * *